US006294877B1

(12) United States Patent
Woodward et al.

(10) Patent No.: US 6,294,877 B1
(45) Date of Patent: Sep. 25, 2001

(54) ARTICLE BLINKING CHRISTMAS TREE ASSEMBLY

(76) Inventors: Thomas W. Woodward; Carole L. Woodward, both of 36015 Glenoaks Rd., Temecula, CA (US) 92592

( * ) Notice: Subject to any disclaimer, the term of this patent is extended or adjusted under 35 U.S.C. 154(b) by 0 days.

(21) Appl. No.: 09/540,514

(22) Filed: Mar. 31, 2000

(51) Int. Cl.[7] ..... F21P 1/02

(52) U.S. Cl. ..... 315/185 S; 362/123; 428/18; D11/118

(58) Field of Search ..... 362/806, 808, 362/122, 123; 315/185 R, 185 S; D11/118; D26/101, 127; 428/18, 19, 20, 7

(56) References Cited

U.S. PATENT DOCUMENTS

| | | | |
|---|---|---|---|
| D. 67,261 | 5/1925 | Bock . | |
| D. 349,359 | 8/1994 | Mclaughlin, II . | |
| 3,655,495 | 4/1972 | Carrell . | |
| 3,967,019 | 6/1976 | Magee . | |
| 5,094,893 * | 3/1992 | Snider | 428/18 |
| 5,213,407 | 5/1993 | Eisenbraun . | |
| 5,489,452 | 2/1996 | Case, Jr. . | |

* cited by examiner

*Primary Examiner*—David Vu

(57) ABSTRACT

A artificial blinking Christmas tree assembly for providing mesmerizing and time-saving Christmas decoration. The artificial blinking Christmas tree assembly includes a base support including a main support member, a plurality of feet members extending from a bottom of the main support member, and a plurality of upright tree support members extending upwardly from a top of the main support member; and also includes a light assembly support member securely mounted upon the base support member; and further includes a light-reflecting member securely disposed within the light assembly support member; and also includes a light-fragmenting member removably disposed about the light assembly support member; and also includes a tree-shaped housing having an open bottom and being removably supported upon the base support member; and further includes a light-emitting element for emitting light through the tree-shaped housing.

14 Claims, 3 Drawing Sheets

ARTICLE BLINKING CHRISTMAS TREE ASSEMBLY

BACKGROUND OF THE INVENTION

1. Field of the Invention

The present invention relates to an artificial blinking Christmas tree and more particularly pertains to a new artificial blinking Christmas tree assembly for providing mesmerizing and time-saving Christmas decoration.

2. Description of the Prior Art

The use of an artificial blinking Christmas tree is known in the prior art. More specifically, an artificial blinking Christmas tree heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,213,407; U.S. Pat. No. 3,655,495; U.S. Pat. No. Des. 349,359; U.S. Pat. No. 5,489,452; U.S. Pat. No. 3,967,019; and U.S. Pat. No. Des. 67,261.

While these devices fulfill their respective, particular objectives and requirements, the aforementioned patents do not disclose a new artificial blinking Christmas tree assembly. The inventive device includes a base support including a main support member, a plurality of feet members extending from a bottom of the main support member, and a plurality of upright tree support members extending upwardly from a top of the main support member; and also includes a light assembly support member securely mounted upon the base support member; and further includes a light-reflecting member securely disposed within the light assembly support member; and also includes a light-fragmenting member removably disposed about the light assembly support member; and also includes a tree-shaped housing having an open bottom and being removably supported upon the base support member; and further includes a light-emitting means for emitting light through the tree-shaped housing.

In these respects, the artificial blinking Christmas tree assembly according to the present invention substantially departs from the conventional concepts and designs of the prior art, and in so doing provides an apparatus primarily developed for the purpose of providing mesmerizing and time-saving Christmas decoration.

SUMMARY OF THE INVENTION

In view of the foregoing disadvantages inherent in the known types of artificial blinking Christmas tree now present in the prior art, the present invention provides a new artificial blinking Christmas tree assembly construction wherein the same can be utilized for providing mesmerizing and time-saving Christmas decoration.

The general purpose of the present invention, which will be described subsequently in greater detail, is to provide a new artificial blinking Christmas tree assembly which has many of the advantages of the artificial blinking Christmas tree mentioned heretofore and many novel features that result in a new artificial blinking Christmas tree assembly which is not anticipated, rendered obvious, suggested, or even implied by any of the prior art artificial blinking Christmas tree, either alone or in any combination thereof.

To attain this, the present invention generally comprises a base support including a main support member, a plurality of feet members extending from a bottom of the main support member, and a plurality of upright tree support members extending upwardly from a top of the main support member; and also includes a light assembly support member securely mounted upon the base support member; and further includes a light-reflecting member securely disposed within the light assembly support member; and also includes a light-fragmenting member removably disposed about the light assembly support member; and also includes a tree-shaped housing having an open bottom and being removably supported upon the base support member; and further includes a light-emitting means for emitting light through the tree-shaped housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new artificial blinking Christmas tree assembly which has many of the advantages of the artificial blinking Christmas tree mentioned heretofore and many novel features that result in a new artificial blinking Christmas tree assembly which is not anticipated, rendered obvious, suggested, or even implied by any of the prior art artificial blinking Christmas tree, either alone or in any combination thereof.

It is another object of the present invention to provide a new artificial blinking Christmas tree assembly which may be easily and efficiently manufactured and marketed.

It is a further object of the present invention to provide a new artificial blinking Christmas tree assembly which is of a durable and reliable construction.

An even further object of the present invention is to provide a new artificial blinking Christmas tree assembly which is susceptible of a low cost of manufacture with regard to both materials and labor, and which accordingly is then susceptible of low prices of sale to the consuming public, thereby making such artificial blinking Christmas tree assembly economically available to the buying public.

Still yet another object of the present invention is to provide a new artificial blinking Christmas tree assembly which provides in the apparatuses and methods of the prior art some of the advantages thereof, while simultaneously overcoming some of the disadvantages normally associated therewith.

Still another object of the present invention is to provide a new artificial blinking Christmas tree assembly for providing mesmerizing and time-saving Christmas decoration.

Yet another object of the present invention is to provide a new artificial blinking Christmas tree assembly which includes a base support including a main support member, a plurality of feet members extending from a bottom of the main support member, and a plurality of upright tree support members extending upwardly from a top of the main support member; and also includes a light assembly support member securely mounted upon the base support member; and further includes a light-reflecting member securely disposed within the light assembly support member; and also includes a light-fragmenting member removably disposed between the light assembly support member; and also includes a tree-shaped housing having an open bottom and being removably supported upon the base support member; and further includes a light-emitting means for emitting light through the tree-shaped housing.

Still yet another object of the present invention is to provide a new artificial blinking Christmas tree assembly that allows users having limited space to have a Christmas tree.

Even still another object of the present invention is to provide a new artificial blinking Christmas tree assembly that is easy and convenient to set up.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
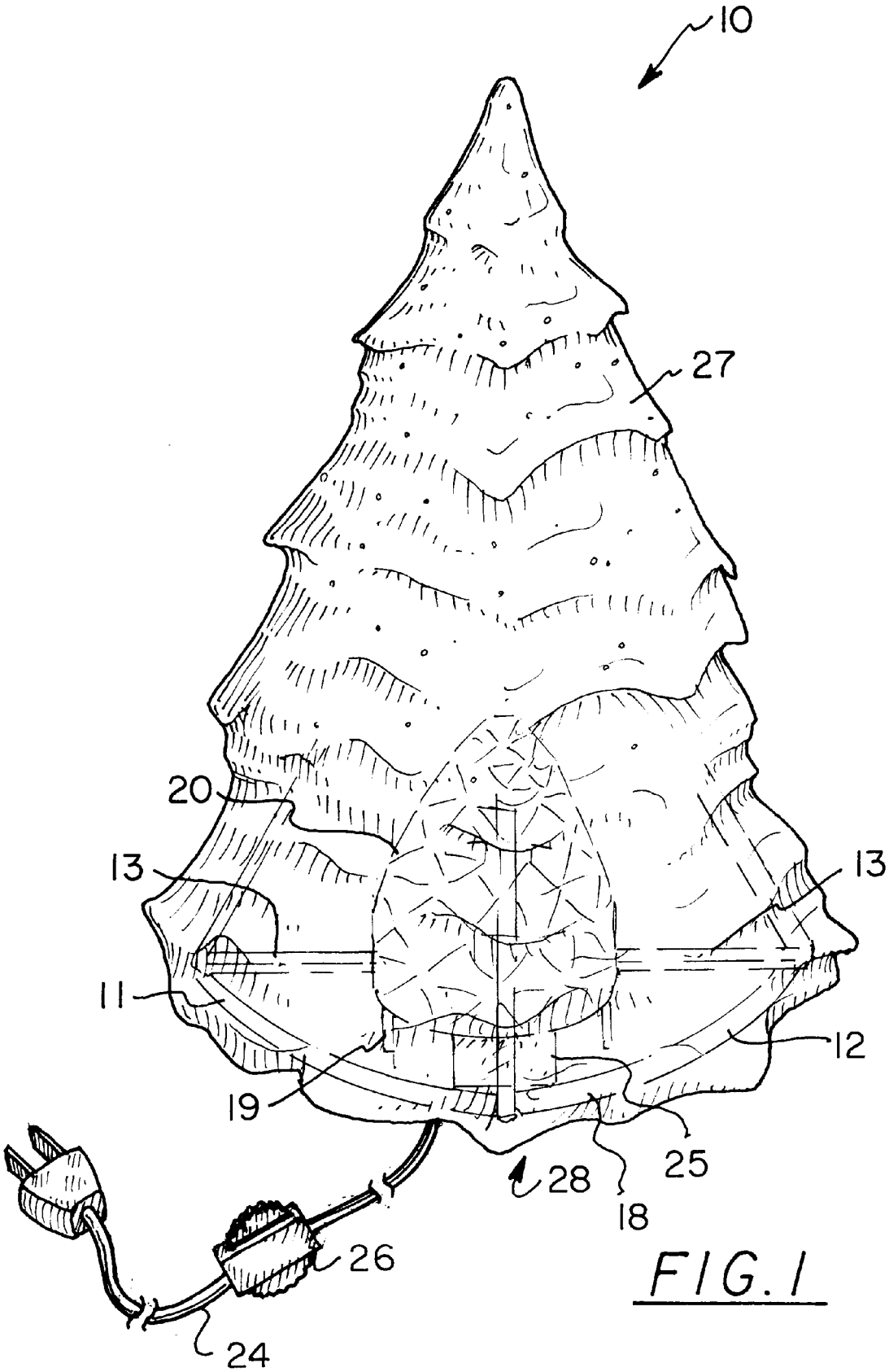
FIG. 1 is a perspective view of a new artificial blinking Christmas tree assembly according to the present invention.
Figure 2:
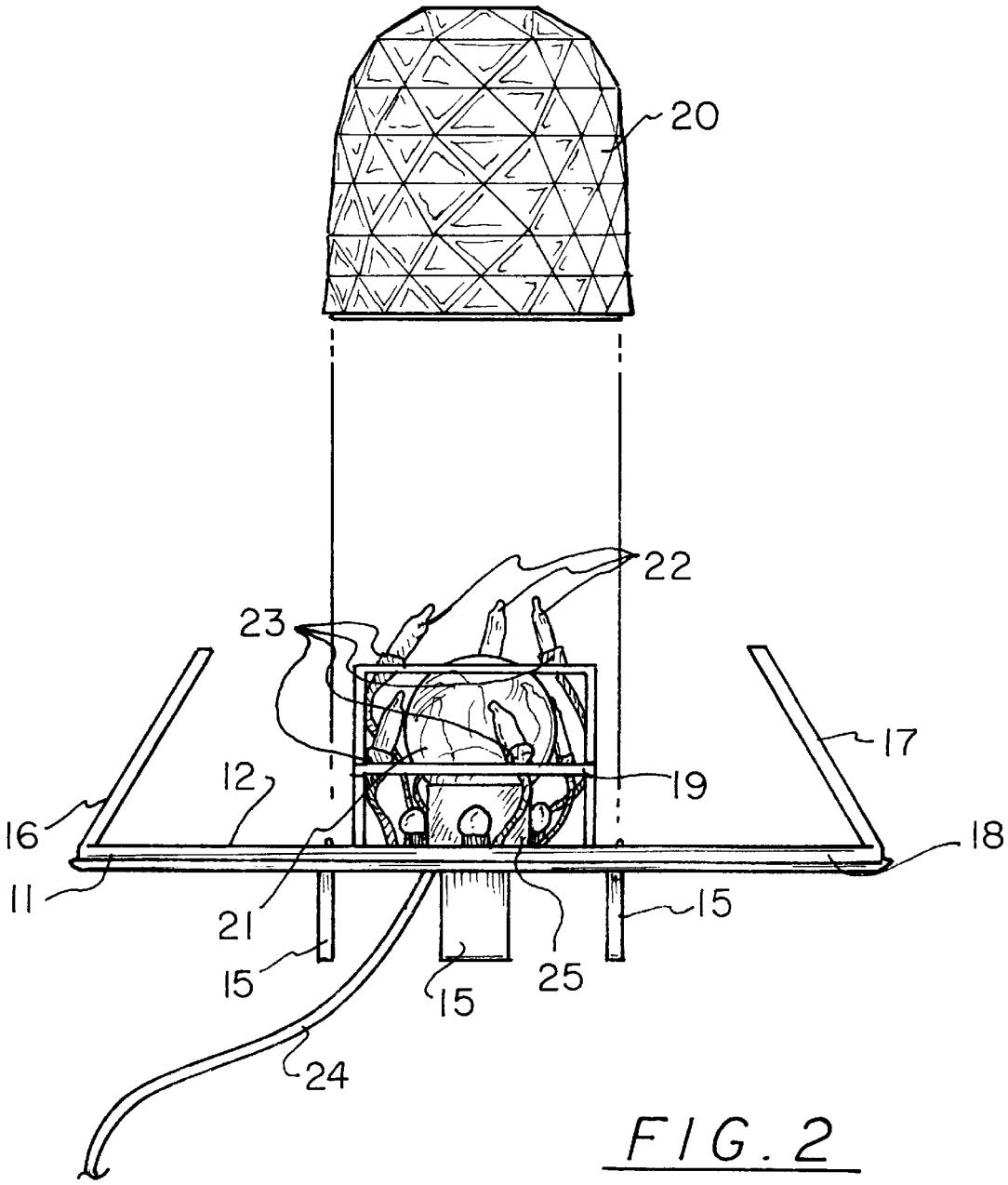
FIG. 2 is an exploded side elevational view of base support member, the light-emitting means, the light assembly support member, the light-reflecting member, and the light-fragmenting member of the present invention.
Figure 3:
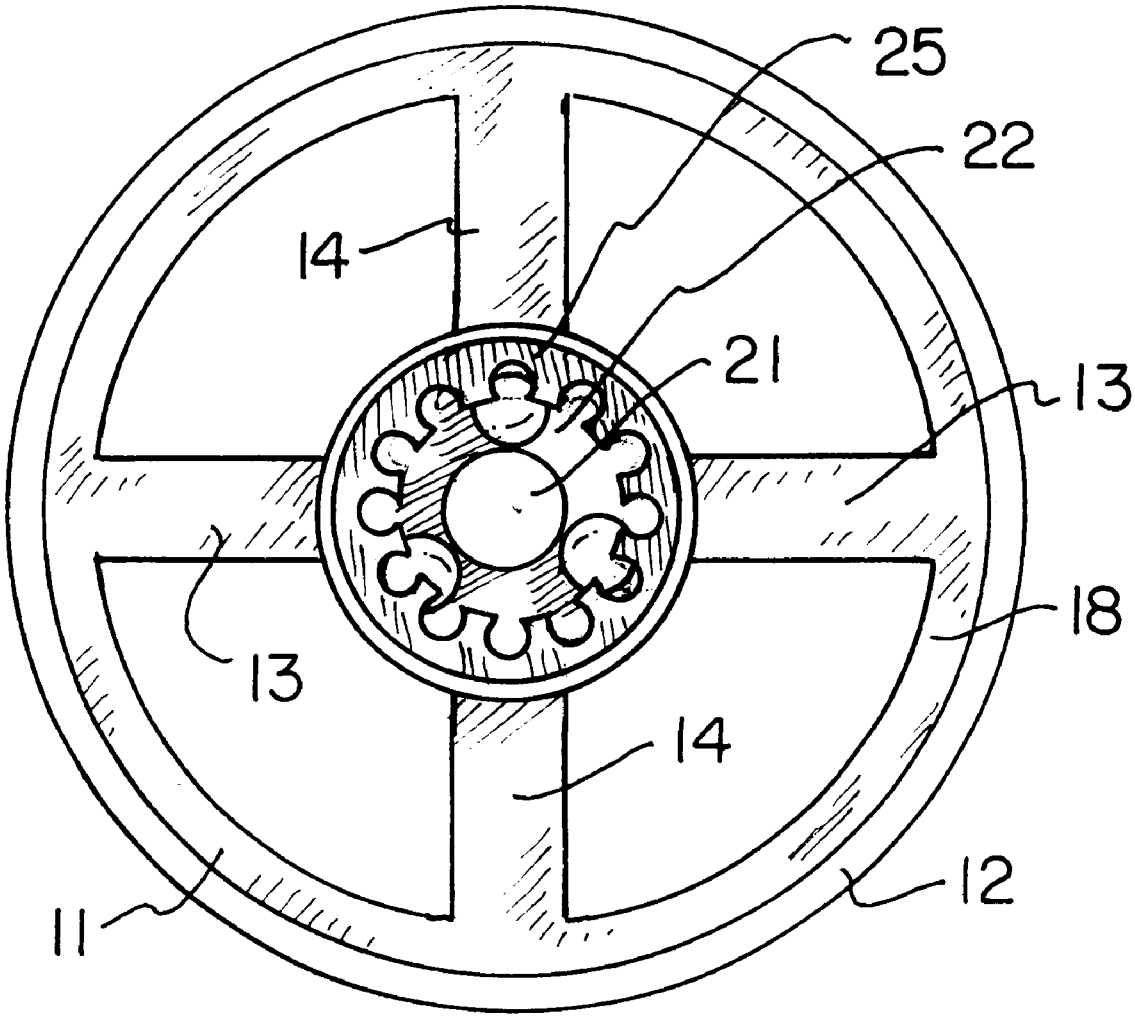
FIG. 3 is a top plan view of the base support member, light-emitting means, and light-reflecting member of the present invention.

With reference now to the drawings, and in particular to FIGS. 1 through 3 thereof, a new artificial blinking Christmas tree assembly embodying the principles and concepts of the present invention and generally designated by the reference numeral 10 will be described.

As best illustrated in FIGS. 1 through 3, the artificial blinking Christmas tree assembly 10 generally comprises a base support 11 including a main support member 18, a plurality of feet members 15 securely and conventionally extending from a bottom of the main support member 18, and a plurality of upright tree support members 16,17 integrally extending upwardly from a top of the main support member 18. The main support member 18 includes a ring member 12 and a plurality of cross members 13,14 securely and conventionally attached to the ring member 12 with the upright tree support members 16,17 extending upwardly from the ring member 12 and being angled relative to the ring member 12 and with the upright tree support members 16,17 being angled upwardly and inwardly of the ring member 12.

A light assembly support member 19 is securely and conventionally mounted upon the base support member 11 with the light assembly support member 19 being essentially a fence-like enclosure which is securely mounted upon the cross members 13,14. A light-reflecting member 21 is securely disposed within the light assembly support member 19 with the light-reflecting member 21 being essentially a spherical object securely disposed upon a light-reflecting support platform 25 which is securely and conventionally disposed within the light assembly support member 19 and upon the cross members 13,14. A light-fragmenting member 20 having an annular flange extending from a bottom edge thereof is removably disposed about the light assembly support member 19 with the light-fragmenting member 20 being essentially a crystal bowl being disposed upside down and being removably disposed about the light assembly support member 19. A tree-shaped housing 27 having an open bottom 28 is removably and conventionally supported upon and about the base support member 11 with the tree-shaped housing 27 being essentially made of semi-transparent plastic and including a snow-covered embossed pattern thereon and further including colored glitter such as silver and gold disposed in and throughout the housing 27 and with the tree-shaped housing 27 being essentially shaped like that of an evergreen tree. The evergreen tree is securely and removably disposed over and about the base support member 11 and has a base diameter of approximately 12 inches and a height of approximately 20 inches. A light-emitting means for emitting light through the tree-shaped housing 27 includes a plurality of light-emitting members 22 removably disposed in light sockets 23 which are connected to a power cord 24 that is adapted to be plugged into a power source; and further includes a switch 26 which is conventionally connected in-line to the power cord 24 for energizing the light-emitting members 22 and for controlling blinking of the light-emitting members 22. The light-emitting members 22 are securely disposed within the light assembly support member 19 and about the spherical object, and as an alternate embodiment, the light-emitting members 22 are securely and conventionally disposed in and about the tree-shaped housing 27.

In use, the user sets up the base support member 11 upon the desired surface, and places the spherical object upon the light-reflecting support member 25, and further places the light-emitting members 22 about the spherical object 21 within the light assembly support member 19, and also places the light-fragmenting member 20 over and about the light-emitting members 22 and the spherical object 21, and further places the tree-shaped housing 27 over and about the base support member 11 and turns on the light-emitting members 22 which emit intermittent light through the semi-transparent tree-shaped housing 27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An artificial Christmas tree assembly comprising:

a base support including a main support member, a plurality of feet members extending from a bottom of said main support member, and a plurality of upright tree support members extending upwardly from a top of said main support member;

a light assembly support member securely mounted upon said base support member;

a light-reflecting member securely disposed within said light assembly support member;

a light-fragmenting member removably disposed about said light assembly support member;

a tree-shaped housing having an open bottom and being removably supported upon said base support member; and a light-emitting means for emitting light through said tree-shaped housing.

2. An artificial blinking Christmas tree assembly as described in claim 1, wherein said main support member includes a ring member and a plurality of cross members securely attached to said ring member.

3. An artificial blinking Christmas tree assembly as described in claim 2, wherein said upright tree support members extend upwardly from said ring member and are angled relative to said ring member, said upright tree support members being angled upwardly and inwardly of said ring member.

4. An artificial blinking Christmas tree assembly as described in claim 3, wherein said light assembly support member is essentially a fence-like enclosure which is securely mounted upon said cross members.

5. An artificial blinking Christmas tree assembly as described in claim 4, wherein said light-fragmenting member is essentially a crystal bowl being disposed upside down and being removably disposed about said light assembly support member.

6. An artificial blinking Christmas tree assembly as described in claim 5, wherein said light-reflecting member is essentially a spherical object securely disposed upon a light-reflecting support platform which is securely disposed within said light assembly support member and upon said cross members.

7. An artificial blinking Christmas tree assembly as described in claim 6, wherein said tree-shaped housing is essentially made of semi-transparent plastic and includes a snow-covered embossed pattern and further includes colored glitter disposed through said housing.

8. An artificial blinking Christmas tree assembly as described in claim 7, wherein said tree-shaped housing is essentially shaped like that of an evergreen tree.

9. An artificial blinking Christmas tree assembly as described in claim 8, wherein said evergreen tree is securely and removably disposed over and about said base support member.

10. An artificial blinking Christmas tree assembly as described in claim 9, wherein said light-emitting means includes a plurality of light-emitting members removably disposed in light sockets which are connected to a power cord that is adapted to be plugged into a power source; and further includes a switch which is connected in-line to said power cord for energizing said light-emitting members and for controlling blinking of said light-emitting members.

11. An artificial blinking Christmas tree assembly as described in claim 10, wherein said light-emitting members are securely disposed within said light assembly support member and about said spherical object.

12. An artificial blinking Christmas tree assembly as described in claim 11, wherein said light-emitting members are securely disposed in and about said tree-shaped housing.

13. An artificial Christmas tree comprising:

a base support including a main support member, a plurality of feet members extending from a bottom of said main support member, and a plurality of upright tree support members extending upwardly from a top of said main support member, said main support member including a ring member and a plurality of cross members securely attached to said ring member, said upright tree support members extending upwardly from said ring member and being angled relative to said ring member, said upright tree support members being angled upwardly and inwardly of said ring member;

a light assembly support member securely mounted upon said base support member, said light assembly support member being essentially a fence-like enclosure which is securely mounted upon said cross members;

a light-reflecting member securely disposed within said light assembly support member, said light-reflecting member being essentially a spherical object securely disposed upon a light-reflecting support platform which is securely disposed within said light assembly support member and upon said cross members;

a light-fragmenting member removably disposed about said light assembly support member, said light-fragmenting member being essentially a crystal bowl being disposed upside down and being removably disposed about said light assembly support member;

a tree-shaped housing having an open bottom and being removably supported upon said base support member, said tree-shaped housing being essentially made of semi-transparent plastic and including a snow-covered embossed pattern and further including colored glitter disposed throughout said housing, said tree-shaped housing being essentially shaped like that of an evergreen tree, said evergreen tree being securely and removably disposed over and about said base support member and having a base diameter of approximately 12 inches and a height of approximately 20 inches; and a light-emitting means for emitting light through said tree-shaped housing including a plurality of light-emitting members removably disposed in light sockets which are connected to a power cord that is adapted to be plugged into a power source; and further including a switch which is connected in-line to said power cord for energizing said light-emitting members and for controlling blinking of said light-emitting members, said light-emitting members being securely disposed within said light assembly support member and about said spherical object.

14. An artificial blinking Christmas tree assembly as described in claim 13, wherein said light-emitting members are securely disposed in and about said tree-shaped housing.

* * * * *